US006814610B2

(12) United States Patent
Kurose et al.

(10) Patent No.: US 6,814,610 B2
(45) Date of Patent: Nov. 9, 2004

(54) UNIT FOR INDICATING LIGHTS AND INDICATING LIGHTS

(75) Inventors: Takahiro Kurose, Sakai (JP); Manabu Tsugita, Yao (JP)

(73) Assignee: Patlite Corporation, Osaka (JP)

( * ) Notice: Subject to any disclaimer, the term of this patent is extended or adjusted under 35 U.S.C. 154(b) by 0 days.

(21) Appl. No.: 10/783,348

(22) Filed: Feb. 20, 2004

(65) Prior Publication Data

US 2004/0166743 A1 Aug. 26, 2004

(30) Foreign Application Priority Data

Feb. 21, 2003 (JP) ..... 2003-045041

(51) Int. Cl.[7] ..... F21S 3/00

(52) U.S. Cl. ..... 439/507; 439/367; 362/219

(58) Field of Search ..... 439/507, 701, 439/367–369, 277, 311, 131, 312, 372, 904–905; 362/219; 340/332

(56) References Cited

U.S. PATENT DOCUMENTS 4,953,223 A * 8/1990 Householder ..... 381/387
5,263,876 A * 11/1993 Johnescu et al. ..... 439/620
5,952,915 A 9/1999 Marquardt et al. ..... 340/332
6,346,000 B1 * 2/2002 Orr ..... 439/342
6,604,838 B2 * 8/2003 Jautz ..... 362/225
6,663,421 B1 * 12/2003 Glick et al. ..... 439/507
2001/0027043 A1 * 10/2001 Shiraki et al. ..... 439/188
2003/0100213 A1 * 5/2003 Yoshigi et al. ..... 439/372

FOREIGN PATENT DOCUMENTS

JP 7-282605 10/1995
JP 2000-082846 3/2000

* cited by examiner

*Primary Examiner*—Michael C. Zarroli
(74) *Attorney, Agent, or Firm*—Koda & Androlia

(57) ABSTRACT

A unit for indicating lights (3*a*, 3*b*, 3*c*, 5, 6, 7) includes a cylindrical case (11). Opposite end portions (18, 19) of the case (11) are each connected with a corresponding end portion (19, 18) of a case (11) of a corresponding unit (3*a*, 3*b*, 3*c*, 5, 6, 7) through relative rotation of the cases. An electrical connection member (14, 140, 141, 142) extended between the opposite end portions (18, 19) of the case (11) establishes electrical connection between units (3*a*, 3*b*, 3*c*, 5, 6, 7) corresponding to each other. First and second ends (28, 29) of the electrical connection member (14, 140, 141, 142) are provided with first and second terminal portions (31, 31*a*; 32, 32*a*), respectively. At least one of the first and second terminal portions (31, 31*a*; 32, 32*a*) is provided at the plate member (15, 150, 151, 142) and includes a contact portion (42, 42*b*) capable of resiliently establishing linear or face-to-face contact with a corresponding terminal portion (31, 31*a*; 32, 32*a*) of a corresponding unit (3*a*, 3*b*, 3*c*, 5, 6, 7).

19 Claims, 16 Drawing Sheets

UNIT FOR INDICATING LIGHTS AND INDICATING LIGHTS

BACKGROUND OF THE INVENTION

1. Field of the Invention

The present invention relates to a unit for indicating lights and indicating lights installed at, for example, automated machine systems, production lines, parking lots and dangerous areas for indicating, based on a signal, various states such as shortage of a material, workpiece jam, a full state of the parking lot, a dangerous state and the like.

2. Description of Related Art

As a conventional indicating lights, there is known, for example, indicating lights including a plurality of units stacked on top of each other. The unit has a cylindrical case and a plate-like terminal extended along an axial direction of the case. Corresponding units are stacked with their corresponding terminals contacting each other to establish electrical connection and then, a long fixing screw is extended through these units for securing the corresponding units to each other (see, for example, JP-A-282605 and JP-A-2000-82846).

Unfortunately, the conventional indicating lights have the following drawback. When the long fixing screw is inserted through the units to assemble these, the stacked units, which are not yet connected with each other, need be held in place with hand. This leads to a cumbersome assembly step requiring time and labor.

As another conventional indicating lights, there is known an assembly including a unit having a cylindrical case and a linear terminal extended axially of the case and bent at one end thereof. The indicating lights are arranged such that the cases of corresponding units in stacked relation are rotated relative to each other thereby establishing connection therebetween while bringing their linear terminals into contact in a crossed manner (see, for example, U.S. Pat. No. 5,952,915).

However, this type of conventional indicating lights suffers unstable electrical connection because the pair of linear terminals of the pair of units connected with each other are brought into point contact.

SUMMARY OF THE INVENTION

An object of the invention is to provide a unit for indicating lights and indicating lights which can save labor for assembling the units and ensures the positive electrical connection between the units.

In accordance with a preferred embodiment of the invention for achieving the above object, a stackable unit for indicating lights comprises: a cylindrical case having first and second end portions; a pair of connection means disposed at the first and second end portions of the case, respectively, and each establishing connection with a corresponding end portion of a case of a corresponding unit via relative rotation of the cases; and an electrical connection member extended between the first and second end portions of the case for establishing electrical connection between units corresponding to each other, wherein the electrical connection member at least includes a plate member as a part thereof, wherein first and second ends of the electrical connection member are provided with first and second terminal portions, respectively, each terminal portion establishing connection with a corresponding terminal portion of a corresponding unit, and wherein at least one of the first and second terminal portions is provided at the plate member and includes a contact portion capable of resiliently establishing linear or face-to-face contact with a corresponding terminal portion of a corresponding unit.

According to the embodiment, when the indicating lights are assembled, a unit and a corresponding unit thereto can be readily connected with each other by stacking a case of the corresponding unit on that of the unit and then relatively rotating the cases to each other.

DETAILED DESCRIPTION OF THE PREFERRED EMBODIMENTS

Figure 1A:
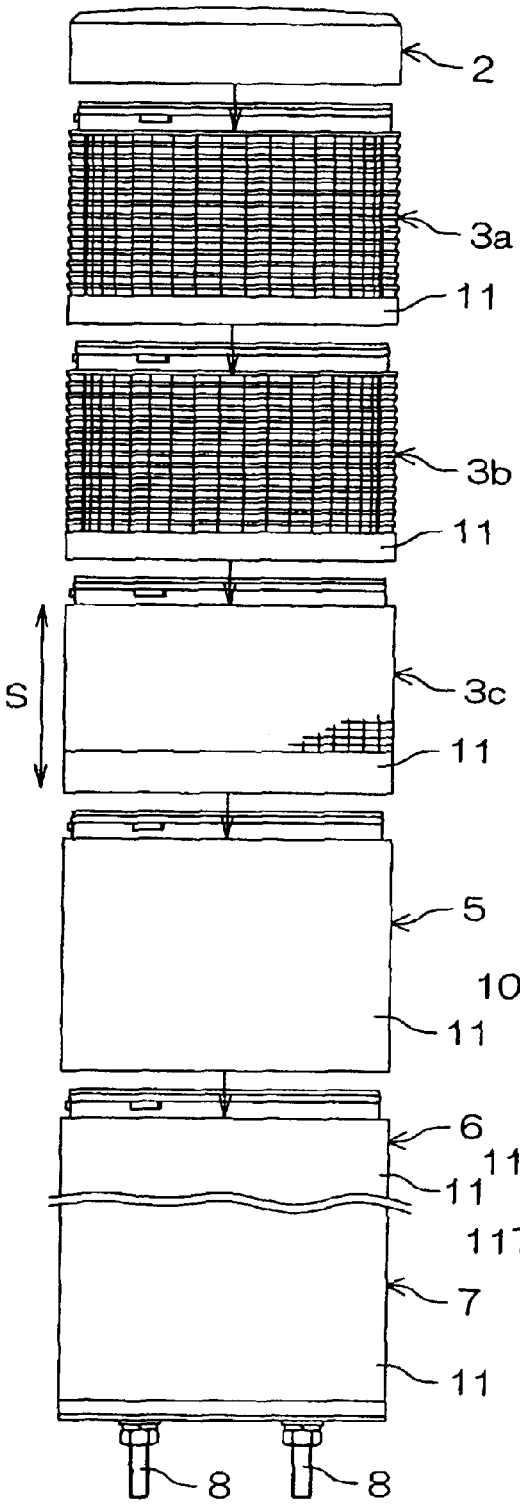
FIG. 1A is a disassembled front view of indicating lights according to a first embodiment of the invention, FIG. 1B representing a front view of the assembled indicating lights.

Hereinafter, indicating lights and units for the indicating lights according to a first embodiment of the invention will be described with reference to the accompanying drawings. First, FIG. 1 explanatory of how to assemble the units are referred to.

Indicating lights 1 include a cover 2 disposed atop the indicating lights 1, and a plurality of, say six, units 3*a*, 3*b*, 3*c*, 5, 6, 7, which are connectably stacked on top of each other along a stacking direction S and locked to each other. The units 3*a*, 3*b*, 3*c*, 5, 6, 7 are substantially shaped like a cylinder and connected with each other as axially aligned.

Specifically, the units 3*a*, 3*b*, 3*c* are annunciator units, which are each adapted to emit light for indication of a signal and have the same configuration. The unit 5 is a buzzer unit adapted to output an audible signal. The unit 6 is an output unit to external, which outputs a signal corresponding to a signal from an apparatus main body 9 (only a part thereof is shown in the figure) on which the indicating lights 1 are mounted, so that the outputted signal may be used by an external apparatus (not shown). The unit 7 is a base unit disposed near a base portion of the indicating lights 1. The unit 7 is provided with a fixing member 8 at an end thereof, which is used for fixing the indicating lights 1 to the apparatus main body 9.

The following description will be made on the basis of the unit 3*b* by way of an example where the unit 3*b* is connected with each of the corresponding units 3*a* and 3*c*.

Figure 2:
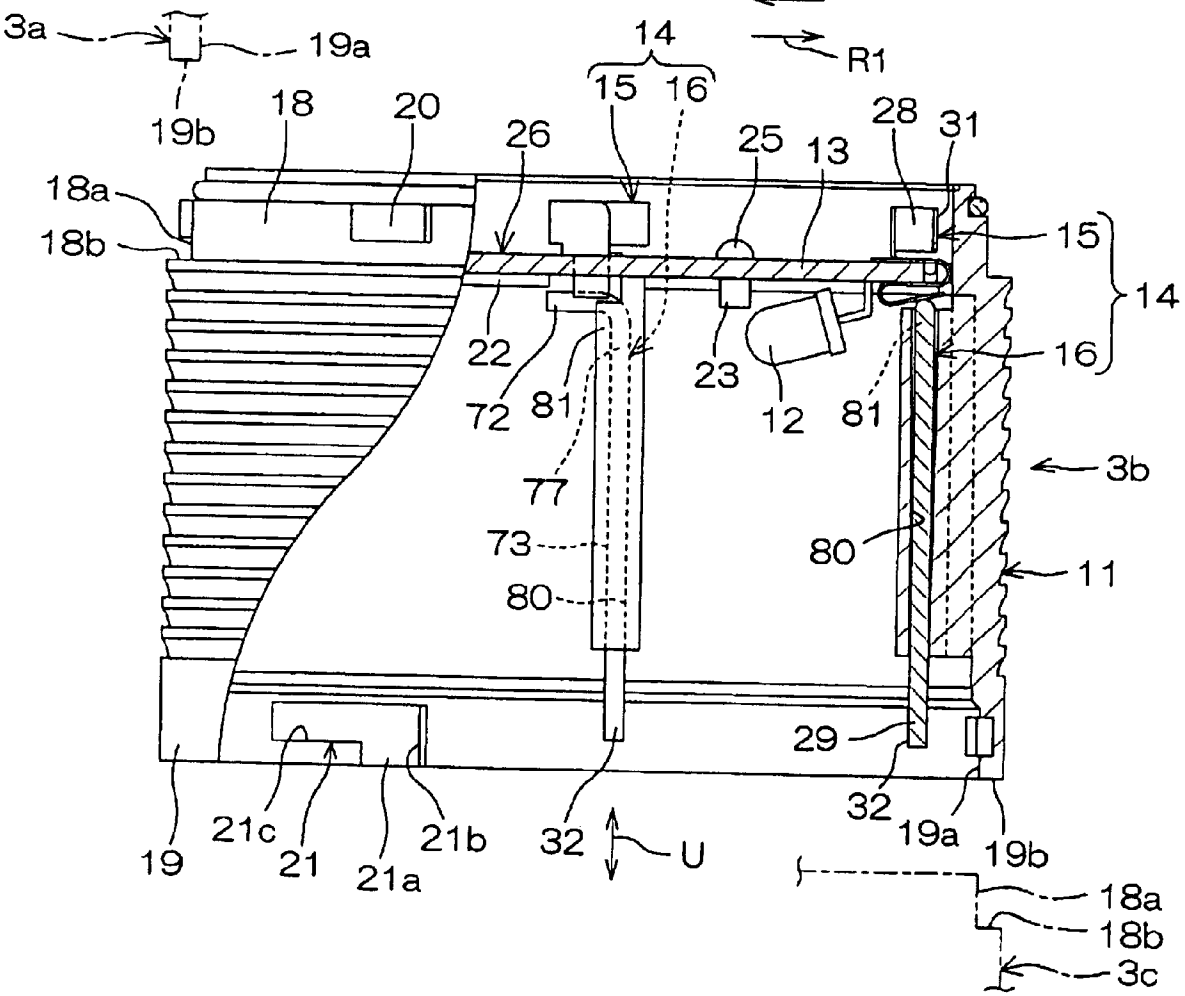
FIG. 2 is a partly cross-sectional front view of the annunciator unit shown in FIG. 1.
Figure 3:
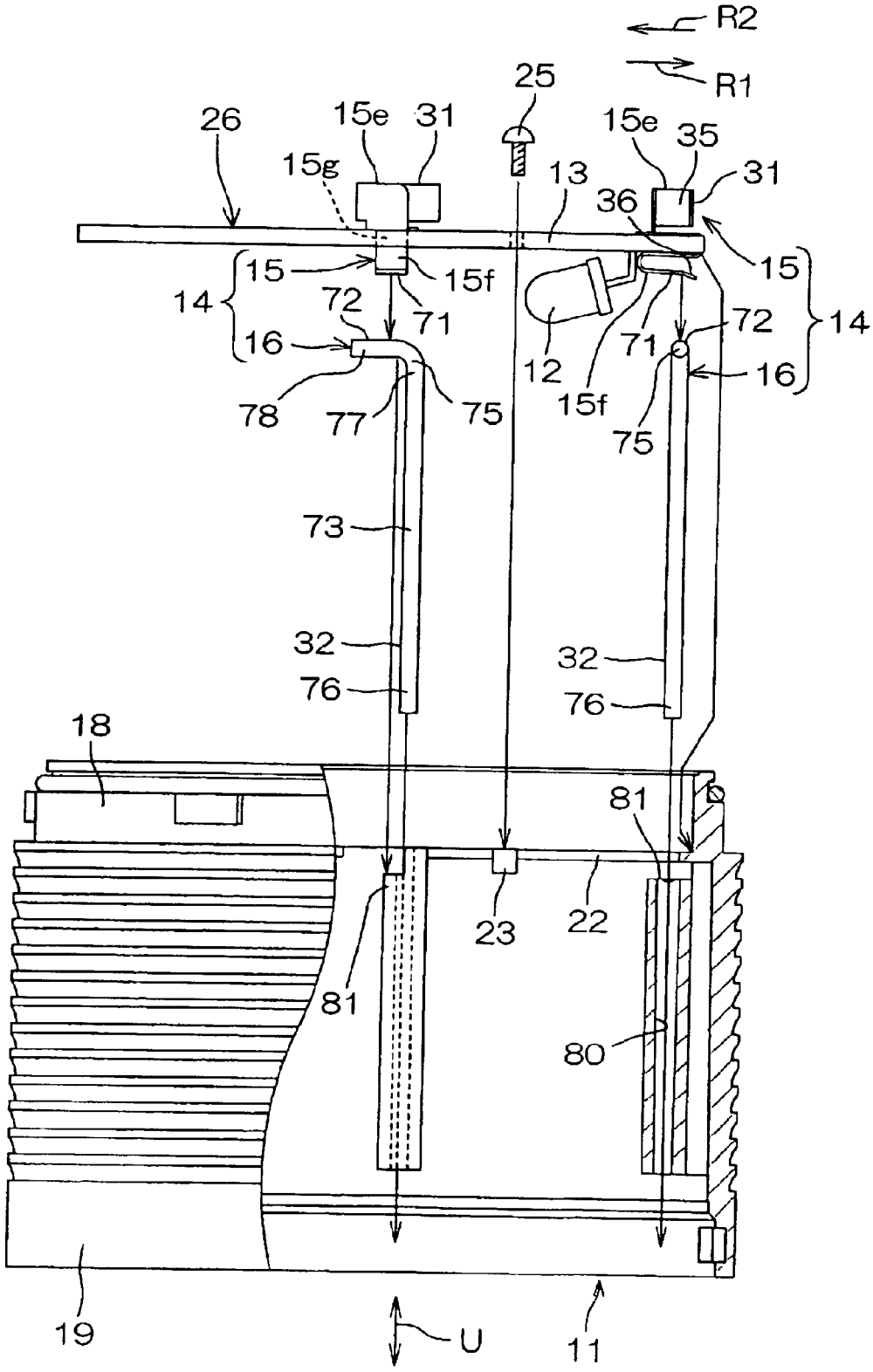
FIG. 3 is a partly cross-sectional and partly disassembled front view of the annunciator unit shown in FIG. 1.

Referring to FIGS. 2 and 3, the unit 3*b* has a cylindrical case 11. The unit 3*b* further includes a plurality of, say eight, light sources 12 of LEDs capable of emitting light; a circuit board 13 supporting the light sources 12 and the like as retained by the case 11; and a plurality of electrical connection members 14 (two of them are shown in FIGS. 2 and 3) for electrical connection between the case 3*b* and each of the corresponding units 3*a* and 3*c*. These light sources 12, circuit board 13 and electrical connection members 14 are substantially accommodated in the case 11.

According to the embodiment, the electrical connection member 14 includes a plate member 15 as a first member and a wire 16 as a second member, the first and second members designed to be interconnectable. The plate members 15 and the wires 16 are provided in paired relation so as to form, for example, six pairs. The plate member 15 is formed from a metal member as a conductor and assembled to the circuit board 13. The wire 16 is formed from a metal member as a conductor and retained by the case 11.

The case 11 is formed from a globe transparent to light, thus functioning as a signal indication surface. The globe maybe provided with a lens portion (not shown) as diffusion means for diffusing transmitting light.

Now referring to FIG. 2, a first end portion 18 of the case 11 with respect to an axial direction thereof U has a first fit portion 18*a* formed on an outer periphery thereof, and a connection surface 18*b* formed of an annular step. A second end portion 19 of the case 11 has a second fit portion 19*a* formed on an inner periphery thereof, and a connection surface 19*b* formed of an annular step. The first fit portion 18*a* of this unit 3*b* fits with a second fit portion 19*a* of the corresponding unit 3*a*. The second fit portion 19*a* of this annunciator unit 3*b* fits with a corresponding first fit portion 18*a* of the corresponding unit 3*c*. The pair of corresponding units 3*b*, 3*c* have their corresponding connection surfaces 19*b*, 18*b* abut against each other , thereby aligning their cases 11 with each other with respect to the axial direction U for guiding relative rotation between these cases.

The first and second end portions 18, 19 of the case 11 is formed with an engaging projection 20 and an engagement recess 21, respectively, which constitute a pair of connection means for connection with respective corresponding end portions 19, 18 of cases 11 of the corresponding units 3*a*, 3*c* through relative rotation between the cases.

The engaging projection 20 of this unit 3*b* is provided at the first fit portion 18*a*, so as to be brought into engagement with the corresponding engagement recess 21 of the unit 3*a*. On the other hand, the engagement recess 21 of this unit 3*b* is provided at the second fit portion 19*a*, so as to be brought into engagement with the corresponding engaging projection 20 of the unit 3*c*.

The engagement recess 21 includes a guide groove 21*b* as a guide portion having an open inlet 21*a* at one end thereof and extended along the axial direction U; and a locking groove 21*c* as a locking portion extended from the other end of the guide groove 21*b* along a circumferential direction V for locking the engaging projection 20 of the counterpart unit. Introduced through the inlet 21*a*, the engaging projection 20 of the counterpart unit is guided by the guide groove 21*c* along the axial direction U and then, circumferentially guided by the locking groove 21*c* into locking relation with a circumferential edges of the locking groove 21*c*, whereby both the cases 11 of the units 3*b*, 3*c* are locked to each other so as to be prevented from disengaging from each other along the axial direction U thereof.

Referring to FIGS. 2 and 3, an annular flange 22 for bearing the circuit board 13 is formed on an inside circumference of the first end portion 18 of the case 11. The annular flange 22 is formed with a plurality of bosses 23 (only one of which is shown in the figures). A fixing screw 25 extending through the circuit board 13 is screwed into a threaded hole (not shown) formed in the boss 23, thereby fixing the circuit board 13 to the annular flange 22.

The circuit board 13 is substantially shaped like a disc. The circuit board 13 retains the above light sources 12 as signal generating means for emitting a signal by way of light; a plurality of circuit components (not shown); and the plate members 15 of the electrical connection members 14. The circuit board 13, light sources 12, the above circuit components and the plate members 15 are electrically connected with each other.

On an outside circumference of the circuit board 13, the plurality of, say eight, LEDs as the light sources 12 are circumferentially arranged substantially at regular space intervals. The individual LEDs are oriented to the center of the case 11 as viewed along the axial direction U of the case 11, so that direct light from each LED passes centrally of the case 11 to penetrate a confronting portion of the globe on the opposite side therefrom, thus emerging into peripheral space.

Referring to FIG. 3, the circuit board 13, the light sources 12, the plate members 15 of the electrical connection members 14, the circuit components and the like constitute a sub-assembly 26, such as to be collectively assembled in the case 11 in an assembly step. Both the sub-assembly 26 and the wires 16 are inserted in the case 11 from the first end portion 18 thereof and assembled therein.

The electrical connection members 14, as seen in FIG. 2, are disposed near the inner periphery of the case 11. As viewed along the axial direction U of the case 11, the electrical connection members 14 are arranged along the circumferential direction V at regular space intervals. The electrical connection members 14 are located at such places as not to block the light rays emitted from the individual light sources 12 along radial directions R1, R2 of the case 11.

The electrical connection member 14 includes the plate member 15 and the wire 16 electrically connected with each other and adjoining each other along the axial direction U of the case 11. The electrical connection member 14 extends between the first and second end portions 18, 19 of the case 11. First and second ends 28, 29 of the electrical connection member 14 are located in correspondence to the first and second end portions 18, 19 of the case 11, respectively. The first and second ends 28, 29 of the electrical connection member 14 are respectively provided with first and second terminal portions 31, 32 for connection with respectively corresponding terminal portions 32, 31 of the corresponding units 3*a*, 3*c*.

The plate member 15 of the electrical connection member 14 is located closer to the first end 28 of the electrical connection member 14 than the wire 16. Referring to FIG. 3, the plate member 15 includes one end 15*e*, the other end 15*f* and an intermediate portion 15*g* with respect to the axial direction U of the case 11. The one end 15*e* of the plate member 15 has the aforesaid first terminal portion 31, whereas the other end 15*f* of the plate member 15 has a first internal terminal portion 71 for connection with the wire 16. On the other hand, one end 75 of the wire 16 has a second internal terminal portion 72 for connection with the first internal terminal portion 71 of the plate member 15. The other end 76 of the wire 16 has the aforesaid second terminal portion 32.

Figure 4:
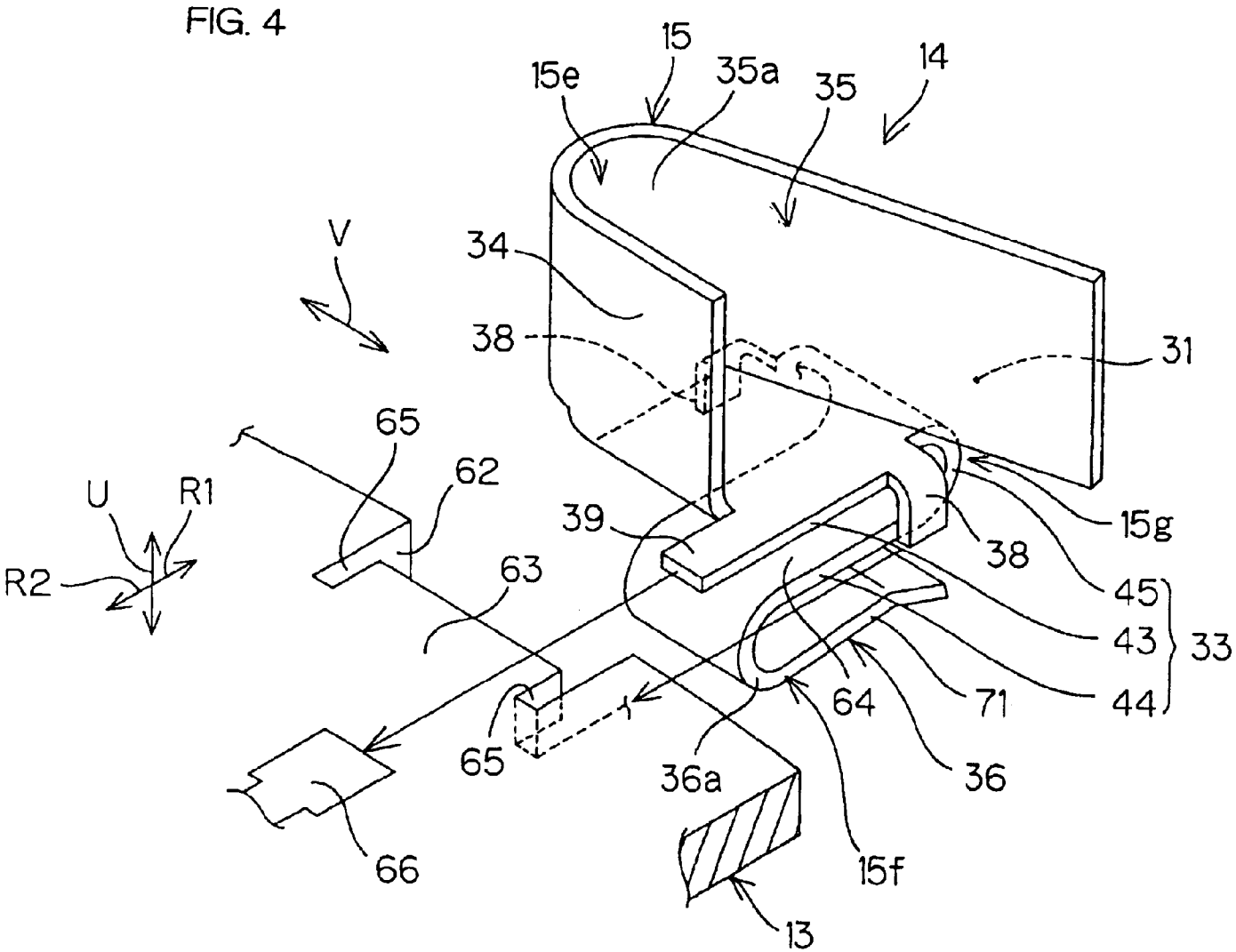
FIG. 4 is a disassembled perspective view of a principal part of a sub-assembly of the annunciator unit.

Referring to FIG. 4, the intermediate portion 15*g* of the plate member 15 has a U-shaped plate portion 33 as a portion to be retained by the circuit board 13. The U-shaped plate portion 33 has a pair of resilient leaves 43, 44 as cantilevered plate spring members interconnected by a connecting portion 45 at respective one end thereof. The intermediate portion 15*g* of the plate member 15 has a pair of projections 38 as positioning engagement portions extended from the resilient plate 43 of the U-shaped plate portion 33; and a projected lead 39 extended from the resilient plate 43 of the U-shaped plate portion 33 and serving as a connection portion with the circuit board 13.

The one end 15*e* of the plate member 15 has an extension portion 34 bendingly extended from an end of the resilient plate 43 of the U-shaped plate portion 33; and a first resilient tongue 35 further extended from the extension portion 34. The other end 15*f* of the plate member 15 has a second resilient tongue 36 extended from the resilient plate 44 of the U-shaped plate portion 33. These portions 33, 35, 36, 38, 39, 34 of the plate member 15 are integrally formed from a single member.

Figure 5A:
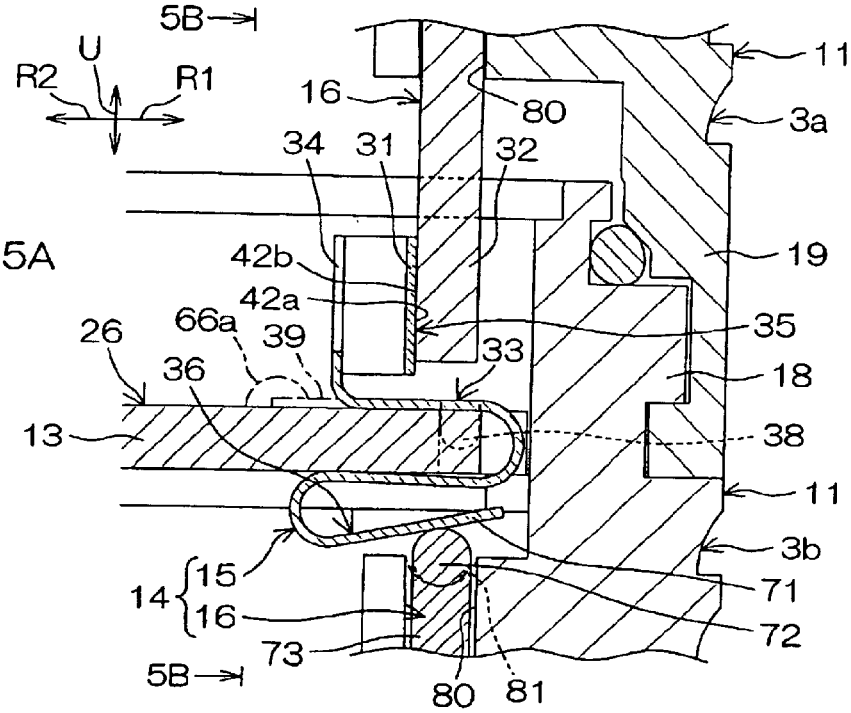
FIGS. 5A–5B are sectional-views showing a connected principal part of the annunciator unit shown in FIG. 1, FIG. 5A representing a cross section taken on the line 5A—5A in FIG. 5B whereas FIG. 5B representing a cross section taken on the line 5B—5B in FIG. 5A.
Figure 5B:
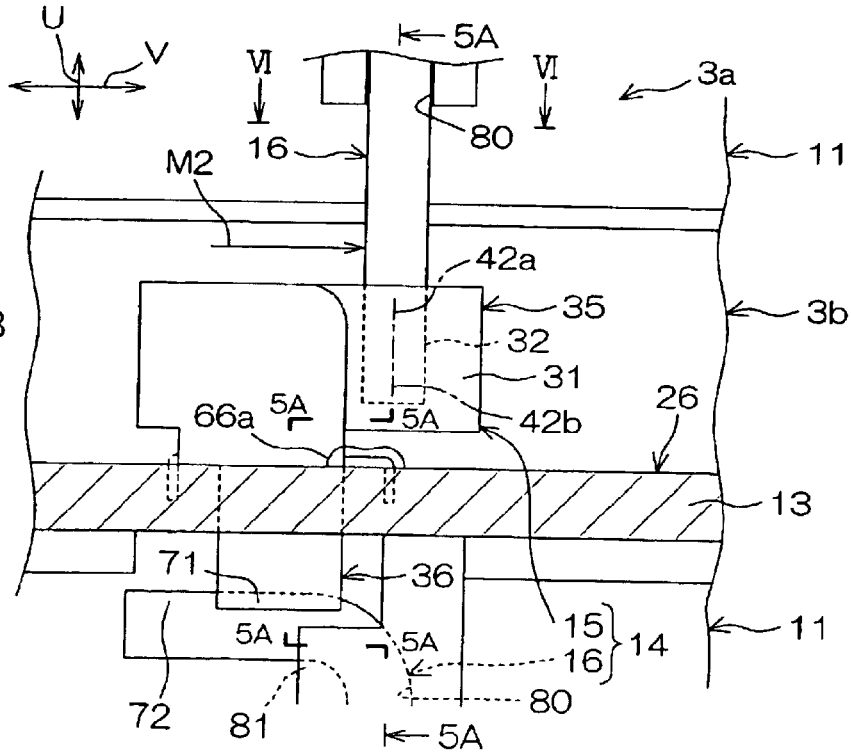

The first resilient tongue 35 extends from a side of the extension portion 34 in a manner to bend back, so as to confront the extension portion 34. The first resilient tongue 35 has a proximal end 35*a* defined by the side of the extension portion 34, thus extending from the proximal end 35*a* substantially along the circumferential direction V of the case 11. The first resilient tongue 35 functions as a cantilevered plate spring member and has the first terminal portion 31 extended from a midportion thereof toward a free end thereof. That is, the first terminal portion 31 is constituted by a part of the first resilient tongue 35 formed from a plate member. As shown in FIGS. 5A and 5B, the first terminal portion 31 includes a contact portion 42*a* capable of resiliently establishing linear contact with a contact portion 42*b* of the second terminal portion 32 of the corresponding wire 16 of the corresponding unit 3*a*.

The first resilient tongue 35 is disposed in a manner that a plane of the plate spring member substantially intersects the radial directions R1, R2 of the case 11. Thus, the first resilient tongue 35 is adapted for resilient deflection substantially along the radial directions R1, R2 of the case 11 and hence, is capable of resiliently biasing the first terminal portion 31 along the radial directions R1, R2.

Figure 6A:
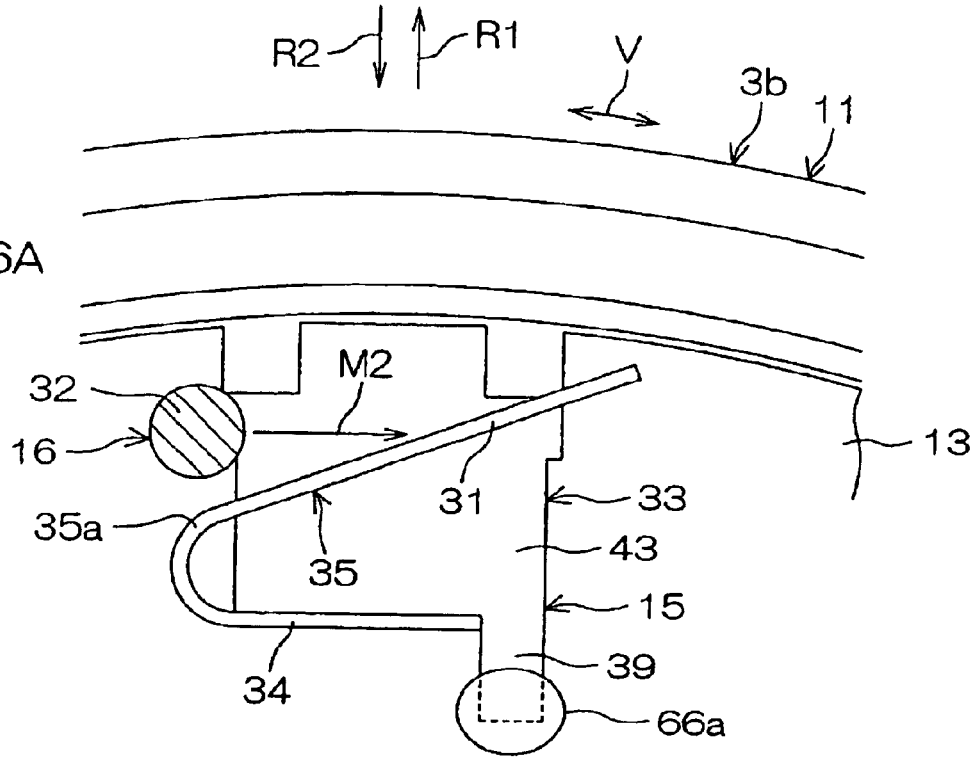
FIGS. 6A–6B are partly cross-sectional plan views showing sequential steps of connecting first and second terminal portions of units corresponding to each other and representing a section taken on the line VI–VI in FIG. 5B, FIG. 6A showing a state before the units are connected with each other whereas FIG. 6B showing the connected units.
Figure 6B:
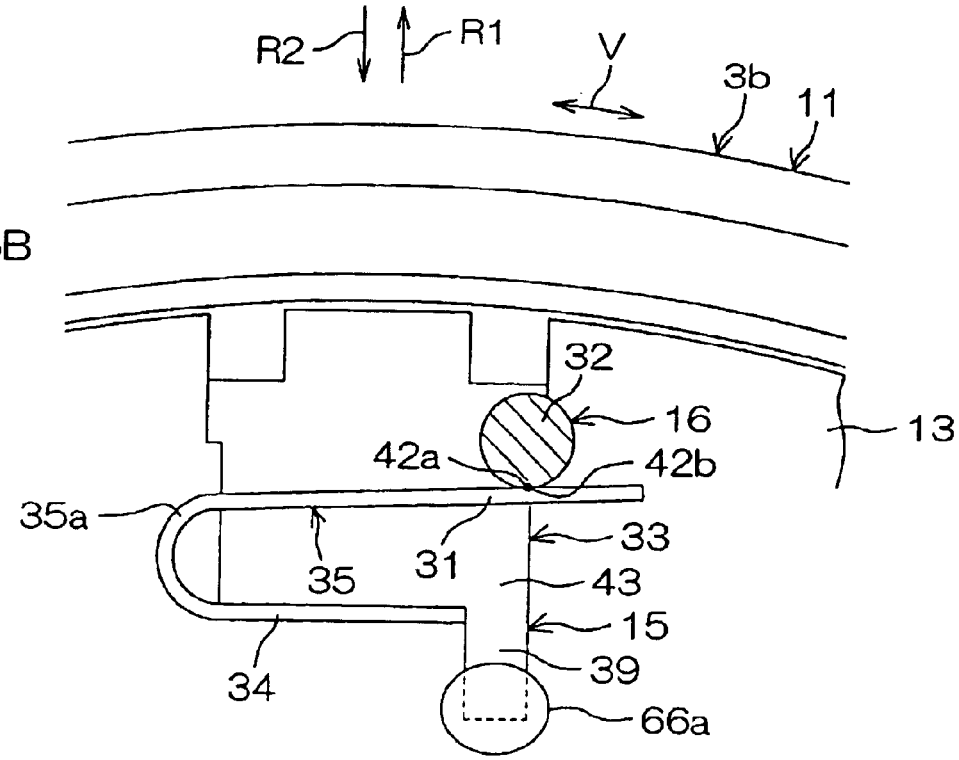

Referring to FIGS. 6A and 6B, when the case 11 of the corresponding unit 3*a* is stacked on the case 11 of the unit 3*b* in the axial direction U thereof and rotated relative to the case 11 of the unit 3*b*, the second terminal portion 32 of the corresponding unit 3*a* presses the first resilient tongue 35 of the unit 3*b* into deflection while moving from the proximal end 35*a* of the first resilient tongue 35 of the unit 3*b* toward the free end thereof (along an arrow M2) A biasing force of the first resilient tongue 35 in the radial direction R1 can assuredly establish electrical connection between the corresponding first terminal portion 31 and second terminal portion 32 of the corresponding units 3*b* and 3*a*. This state holds the respective contact portions 42*a*, 42*b* of the corresponding terminal portions 31, 32 in linear contact.

Returning to FIG. 4, the U-shaped plate portion 33 defines an insertion portion 64 between the pair of resilient leaves 43, 44 thereof such as to receive an outer edge 63 of the circuit board 13. With the pair of resilient leaves 43, 44 clamping therebetween the inserted outer edge 63 of the circuit board 13, the U-shaped plate portion 33 is assuredly retained by the circuit board 13.

The circuit board 13 includes a rectangular notch 62 configured to receive the connecting portion 45 of the U-shaped plate portion 33 and opening toward the outside circumference; the aforesaid outer edge 63 as a retaining portion for retaining the plate member 15; a pair of positioning grooves 65 as positioning portions for positioning the plate member 15 with respect to the radial direction R2 and the circumferential direction V of the case 11; and a connection portion 66 electrically connected with the lead 39 of the plate member 15 by soldering.

The positioning grooves 65 extend from the notch 62 in the radial direction R2. With the projections 38 of the plate member 15 fitted in the positioning grooves 65, the plate member 15 is positioned relative to the circuit board 13 thereby prevented from being displaced relative to the circuit board 13 along the circumferential direction V and radial direction R2. Furthermore, since an external force exerted on the plate member 15 is received by the circuit board 13 via the projections 38, a soldered portion 66*a* between the lead 39 and the connection portion 66 (see FIG. 6) is prevented from receiving an excessive force.

The second resilient tongue 36 is bent back from an end of the resilient plate 44 of the U-shaped plate portion 33 to confront the resilient plate 44. The second resilient tongue 36 has a proximal end 36*a* at the end of the resilient plate 44, thus extending from the proximal end 36*a* substantially along the radial direction R1 of the case 11. The second resilient tongue 36 is formed of the plate member, functioning as a cantilevered plate spring member. The second resilient tongue 36 has the first internal terminal portion 71 extending from a midportion thereof toward a free end thereof. The second resilient tongue 36 is disposed in a manner that a plane of the plate spring member substantially intersects the axial direction U of the case 11, thus adapted to resiliently bias the first internal terminal portion 71 and then the one end 75 of the wire 16 substantially along the axial direction U of the case 11.

Returning to FIG. 3, the wire 16 includes a main body 73 extended straight along the axial direction U of the case 11 and retained by the case 11. The main body 73 is formed with a bent extension 78 at one end 77 thereof which extends orthogonally to the main body. The second internal terminal portion 72 is defined by the bent extension 78. The second terminal portion 32 is defined by the other end of the main body 73 or the other end 76 of the wire 16.

The bent wire 16 may be used to form a part of the electrical connection member 14 at low cost. The second internal terminal portion 72 defined by the bent extension of the wire 16 is in linear contact with the first internal terminal portion 71 of the second resilient tongue 36 of the plate member 15, thereby accomplishing reliable electrical connection.

Referring to FIG. 2, the wire 16 is retained by a retention hole 80 as a retaining portion provided on the inner periphery of the case 11. The retention hole 80 is a through hole extended straight along the axial direction U of the case 11, accommodating the most part of the main body 73.

Referring to FIGS. 5A and 5B, the second internal terminal portion 72 extends along the circumferential direction V of the case 11 as exposed from an opening of the retention hole 80 at the first end portion 18 of the case 11. On the other hand, the second terminal portion 32 extends along the axial direction U of the case 11 as exposed from an opening of the retention hole 80 at the second end portion 19 of the case 11.

A terminal rest 81 for receiving the second internal terminal portion 72 with respect to the axial direction U of the case 11 is formed in a circumference of the opening of the retention hole 80 at the first end portion 18 of the case 11. The first internal terminal portion 71 of the second resilient tongue 36 of the sub-assembly 26 assembled in the -case 11 is biased against the second internal terminal portion 72 of the wire 16 thus received by the terminal rest 81, so that the biasing force may establish an assured electrical connection between the first and second internal terminal portions 71, 72.

According to the embodiment, an assembly step of the indicating lights 1 may be performed in a manner that the case 11 of the unit 3*b* is brought into stacked relation with the case 11 of either one of the corresponding units 3*a*, 3*c* and rotated relative to each other, thereby readily establishing connection between the units 3*a*, 3*b*, 3*c* via the aforementioned connection means without using the long fixing screws employed by the prior art. This results in a reduced labor involved in assembling the indicating lights 1. In addition, the first terminal portion 31 of the plate member 15 and the corresponding second terminal portion 32 of the wire 16, which are included in the electrical connection member 14, are brought into linear contact with each other, thereby assuring the electrical connection therebetween.

Returning to FIG. 3, the electrical connection member 14 is constituted by a plurality of interconnectable separate members or more preferably two such members. This leads to an increased assembly freedom of the unit 3*b* so that the unit 3*b* is easier to assemble. Furthermore, the two-piece structure obviates the increase in the labor for assembling the unit.

The assembling step of the unit 3*b* may be further expedited by adopting the method wherein the sub-assembly 26 previously constructed from the circuit board 13 and the plate member 15 is assembled in the case 11. It is more preferred that the sub-assembly 26 includes the signal generating means.

Referring to FIG. 4, the plate member 15 of the electrical connection member 14 incorporates the first and second resilient tongues 35, 36 extended from the U-shaped plate portion 33 as the retained portion, whereby the plate member 15 can attain a practical, simplified structure.

Referring to FIGS. 5A and 5B, the first internal terminal portion 71 is provided at the second resilient tongue 36, whereby the first and second internal terminal portions 71, 72 can resiliently establish a reliable electrical connection therebetween within the unit 3*b*.

Where the second resilient tongue 36 is capable of resiliently biasing the first internal terminal portion 71 substantially along the axial direction U of the case 11 while the sub-assembly 26 is inserted in the case 11 substantially along the axial direction U thereof to be assembled to the first end portion 18 of the case 11, the sub-assembly 26 can be assembled in the case 11 concurrently with the establishment of the connection between the biased first and second internal terminal portions 71, 72.

Although the lead 39 and the connection portion 66 are interconnected by soldering, the soldering step may be omitted if the resilient force of the U-shaped plate portion 33 ensures the contact between these.

Next, a second embodiment of the invention will be described with reference to FIGS. 7 and 8. It is noted that the following description focuses on differences from the first embodiment so that like parts to the above are represented by the same reference numerals, respectively, and the description thereof is dispensed with. The other embodiments to be discussed hereinafter will be described the same way.

Figure 7:
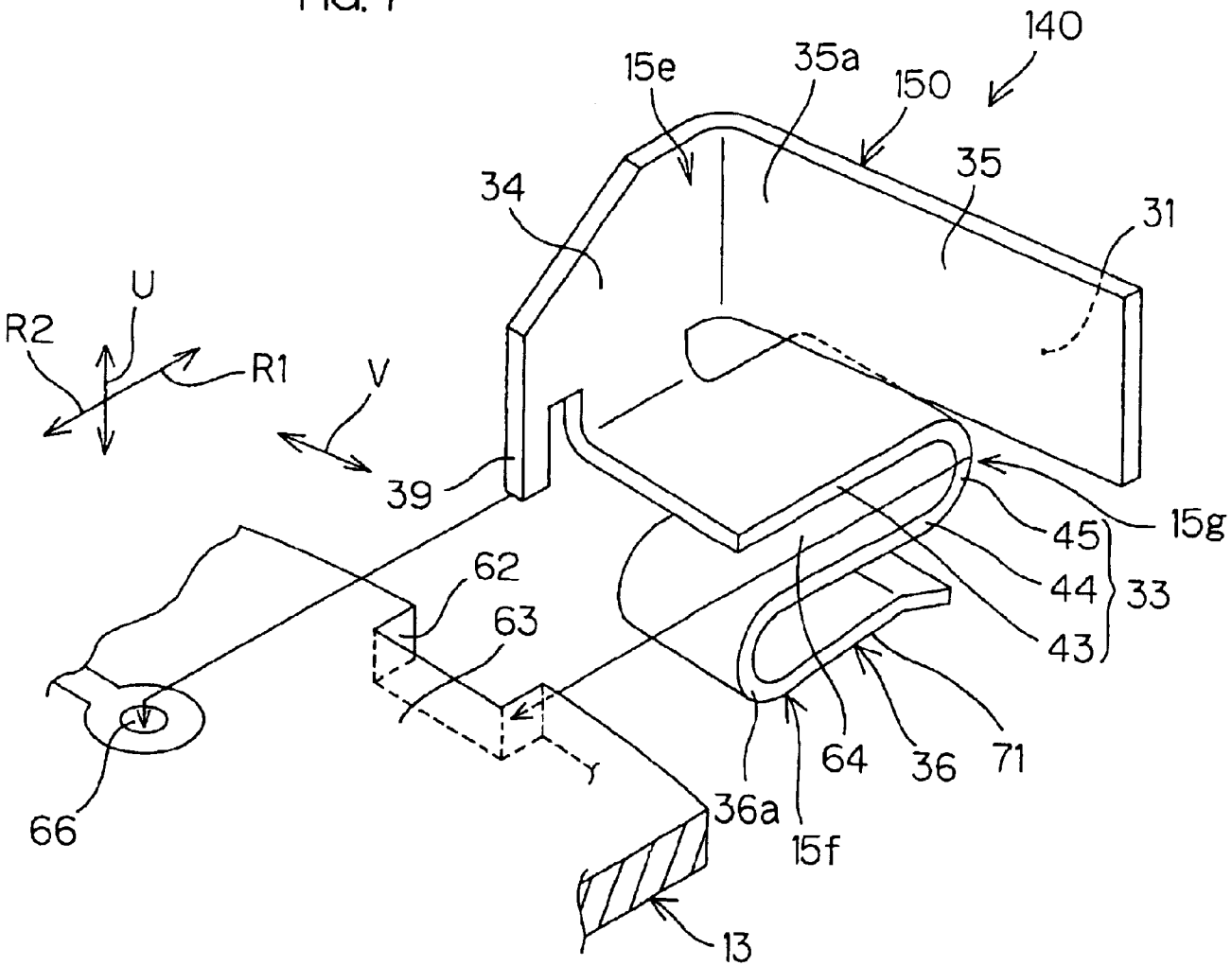
FIG. 7 is a disassembled perspective view of a principal part of a sub-assembly of an annunciator unit according to a second embodiment of the invention.
Figure 8:
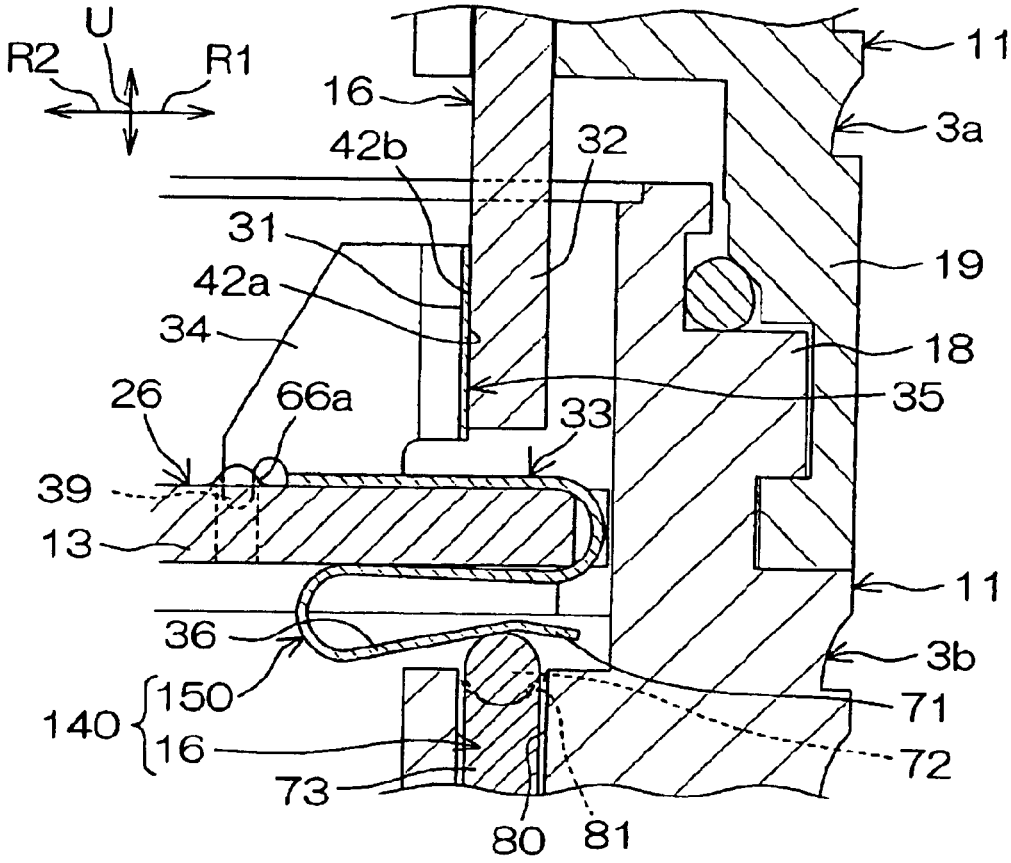
FIG. 8 is a sectional view of the connected principal part of the annunciator unit shown in FIG. 7.

The second embodiment employs an electrical connection member 140 including a plate member 150 shown in FIGS. 7 and 8, which replaces the electrical connection member 14 including the plate member 15 of the first embodiment (see FIG. 4).

The plate member 150 principally differs from the plate member 15 of the first embodiment (see FIG. 4) in the following points. Specifically, the extension portion 34 of the plate member 150 is bendingly extended from the side of the resilient plate 43 of the U-shaped plate portion 33, whereas the first resilient tongue 35 is bendingly extended from the side of the extension portion 34 substantially along the circumferential direction V of the case 11. The lead 39 of the plate member 150 projects from the extension portion 34 along the axial direction U of the case 11 so as to be fitted in the connection portion 66 defined by a through hole in the circuit board 13 and to be soldered to a conductive member in the through hole. The connecting portion 45 of the U-shaped plate portion 33 is fitted in the notch 62 at the outside circumference of the circuit board 13, thus functioning as an engagement portion for positioning the plate member 150 on the circuit board 13 with respect to the circumferential direction V.

Figure 9:
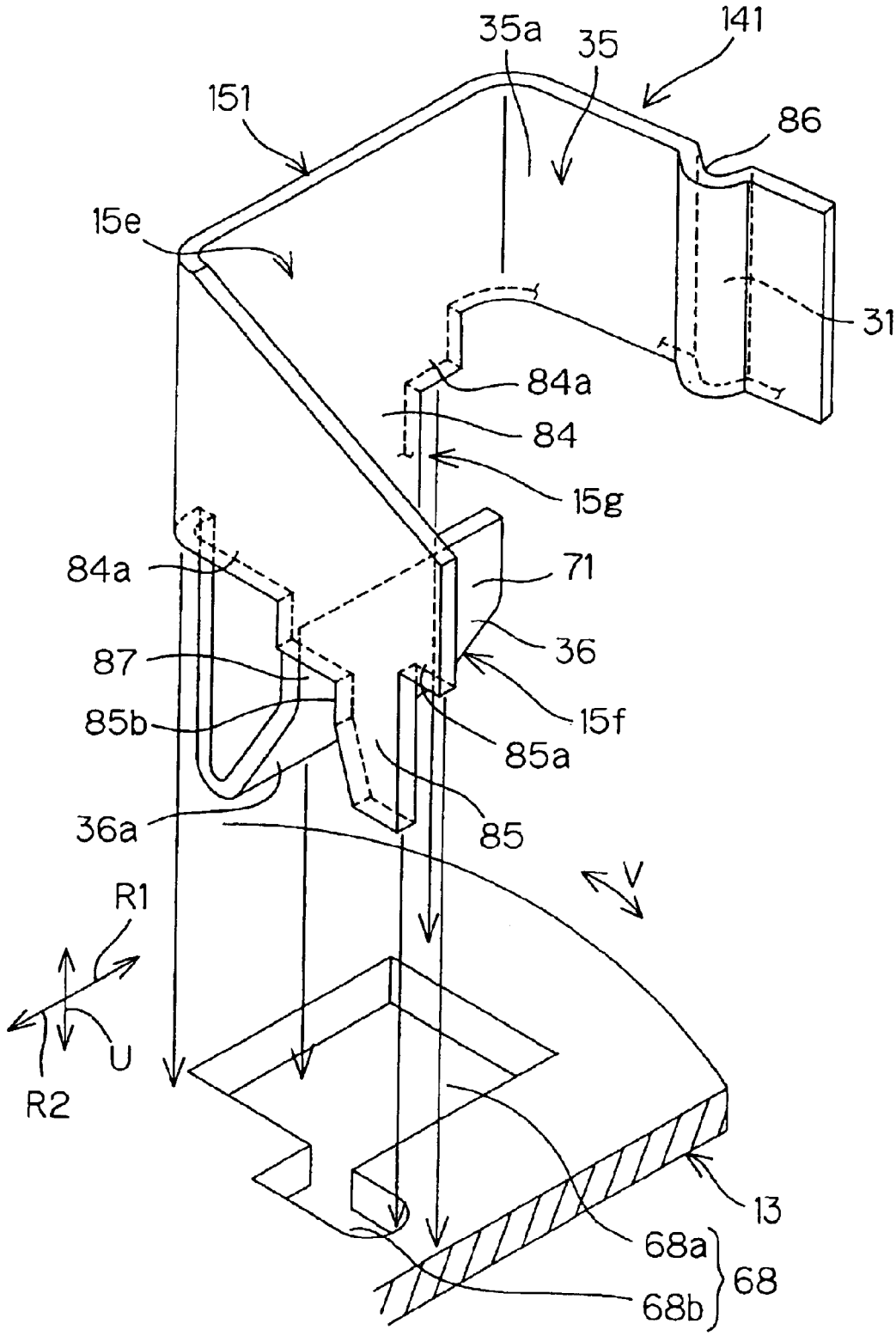
FIG. 9 is a disassembled perspective view of a principal part of a sub-assembly of an annunciator unit according to a third embodiment of the invention.

Next, a third embodiment of the invention will be described with reference to FIGS. 9 to 11. The third embodiment employs an electrical connection member 141 including a plate member 151 shown in FIG. 9 in place of the electrical connection member 14 including the plate member 15 of the first embodiment (see FIG. 4).

The circuit board 13 has a through hole 68 as a retaining portion for retaining the plate member 151 inserted therethrough. The through hole 68 has a first portion 68*a* defining a rectangular main portion, and a groove-like second portion 68*b* extended from the first portion 68*a* along the circumferential direction V.

The plate member 151 includes the one end 15*e*, the other end 15*f* and the intermediate portion 15*g* between these ends with respect to the axial direction U of the case 11. The plate member 151 has a main plate portion 84 retained by the circuit board 13 as fitted in the first portion 68*a* of the through hole 68 thereof, and extending along the axial direction U of the case 11. An intermediate portion of the main plate portion 84 defines a retained portion on the circuit board 13. The one end 15*e* of the plate member 151 has the first resilient tongue 35 bendingly extended from a side of the main plate portion 84. The other end 15*f* of the plate member 151 has the second resilient tongue 36 extended as bent back from an end of the main plate portion 84. The plate member 151 further includes an extension piece 85 which is bendingly extended from a side of the main plate portion 84, as the retained portion, toward a side where the second resilient tongue 36 is bent back and which adjoins the second resilient tongue 36. An intermediate portion of the extension piece 85 is fitted in the second portion 68*b* of the through hole 68, thus functioning as a retained portion. Although not depicted in the figures, the plate member 151 may employ the lead 39 illustrated in the first and second embodiments.

By means of steps 84*a*, 85*a* of the main plate portion 84 and extension piece 85 of the plate member 151 which are fitted with circumferential edges of the through hole 68 in the circuit board 13, the plate member 151 is positioned on the circuit board 13 with respect to one axial direction U. The intermediate portions of the main plate portion 84 and the extension piece 85 abut against the circumferential edges of the through hole 68, thereby positioning the plate member 151 on the circuit board 13 with respect to the circumferential direction V and radial directions R1, R2 of the case 11.

In this embodiment, as well, the first resilient tongue 35 includes the first terminal portion 31, whereas the second resilient tongue 36 includes the first internal terminal portion 71.

The first resilient tongue 35 differs from that of the first embodiment in that the resilient tongue is bendingly extended from its proximal end 35*a* defined by a side of the main plate portion 84 and that the first terminal portion 31 is formed with a flute 86.

The flute 86 is adapted to contact the second terminal portion 32 at plural places. This ensures a more reliable electrical connection between the first terminal portion 31 and the second terminal portion 32. As shown in FIG. 11, for example, the flute 86 is in linear contact with the wire 16 at two places circumferentially spaced from each other.

Figure 10A:
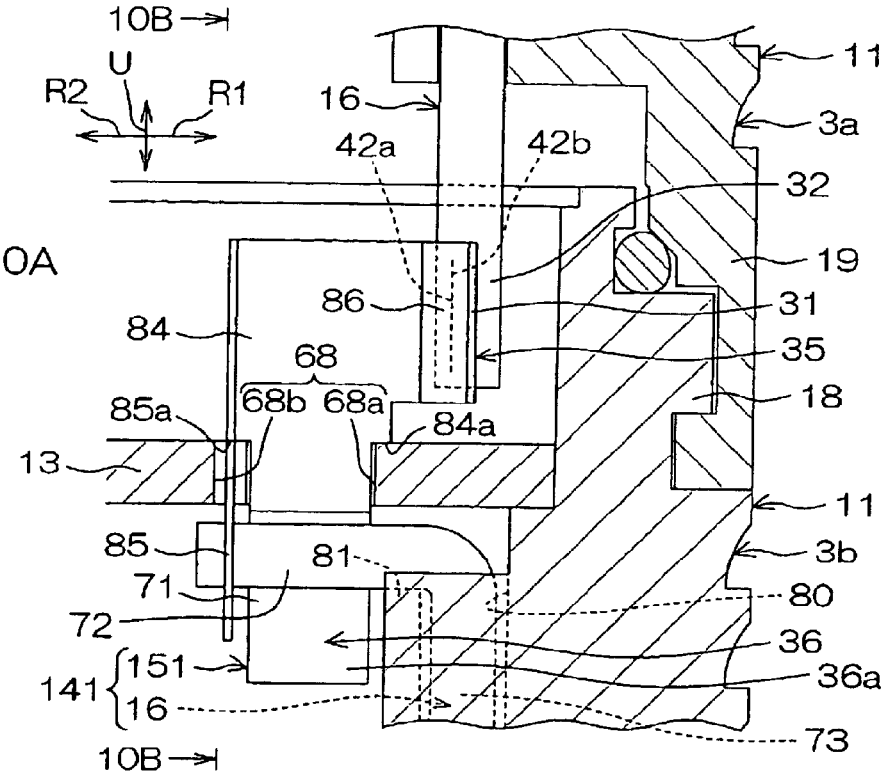
FIGS. 10A–10B are sectional views showing a connected state of the annunciator unit shown in FIG. 9, FIG. 10A representing a cross section taken on the line 10A—10A in FIG. 10B whereas FIG. 10B representing a cross section taken on the line 10B—10B in FIG. 10A.
Figure 10B:
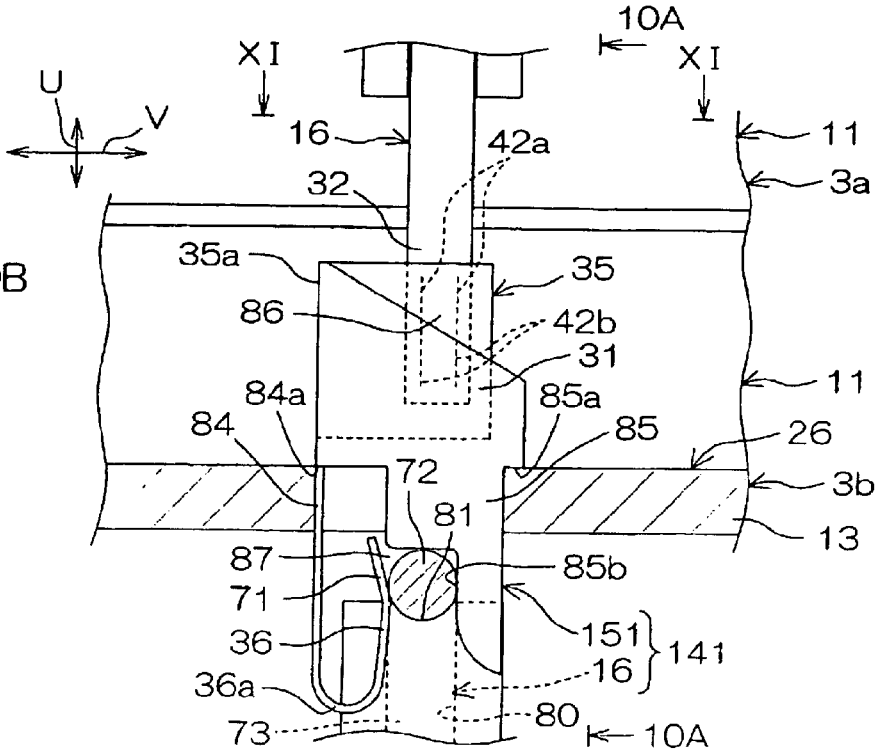

Returning to FIG. 9, the second resilient tongue 36 differs from that of the first embodiment in the following points. Specifically, the second resilient tongue 36 has the proximal end 36*a* defined by an end of the main plate portion 84, thus bent back at the proximal end 36*a* to extend substantially along the axial direction U. Furthermore, the second resilient tongue 36 is disposed in a manner that a plane thereof substantially intersects the circumferential direction V of the case 11, thus adapted to resiliently bias the first internal terminal portion 71 substantially along the circumferential direction V of the case 11. As shown in FIGS. 10A and 10B, the first and second internal terminal portions 71, 72 are in linear contact as biased against each other. The second internal terminal portion 72 of the wire 16 is so disposed as to extend in the radial direction R2 of the case 11. This provides a sufficient contact length between the first and second internal terminal portions 71, 72, while allowing the terminal portions to block less light from the light source 12.

The extension piece 85 has an edge portion 85*b* extended along the axial direction U of the case 11. Defined between the edge portion 85*b* of the extension piece 85 and the second resilient tongue 36 is a clamping portion 87 in which the second internal terminal portion 72 of the wire 16 of the unit 3*b* is clamped. This provides for the positive and stable positioning of the biased wire 16 and for the electrical connection between the extension piece 85 and the second internal terminal portion 72. As a result, it is ensured that the plate member 151 is electrically connected with the wire 16. Furthermore, since the plate member 151 clamps the wire 16 along the circumferential direction V of the case 11, the plate member 151 and the circuit board 13 may be subjected to less force exerted by the wire 16 in the axial direction V of the case 11.

Figure 12:
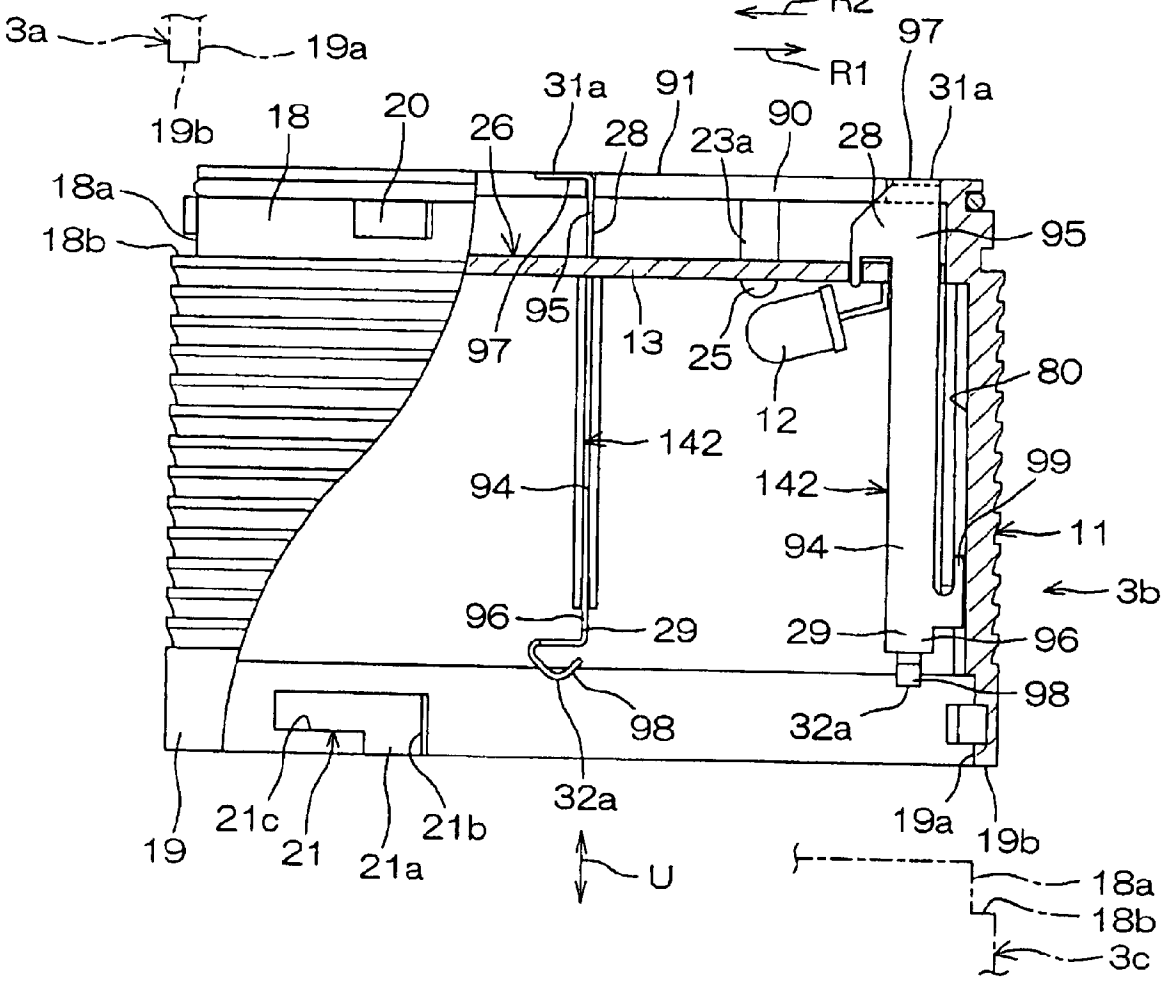
FIG. 12 is a partly cross-sectional front view of an annunciator unit according to a fourth embodiment of the invention.
Figure 13:
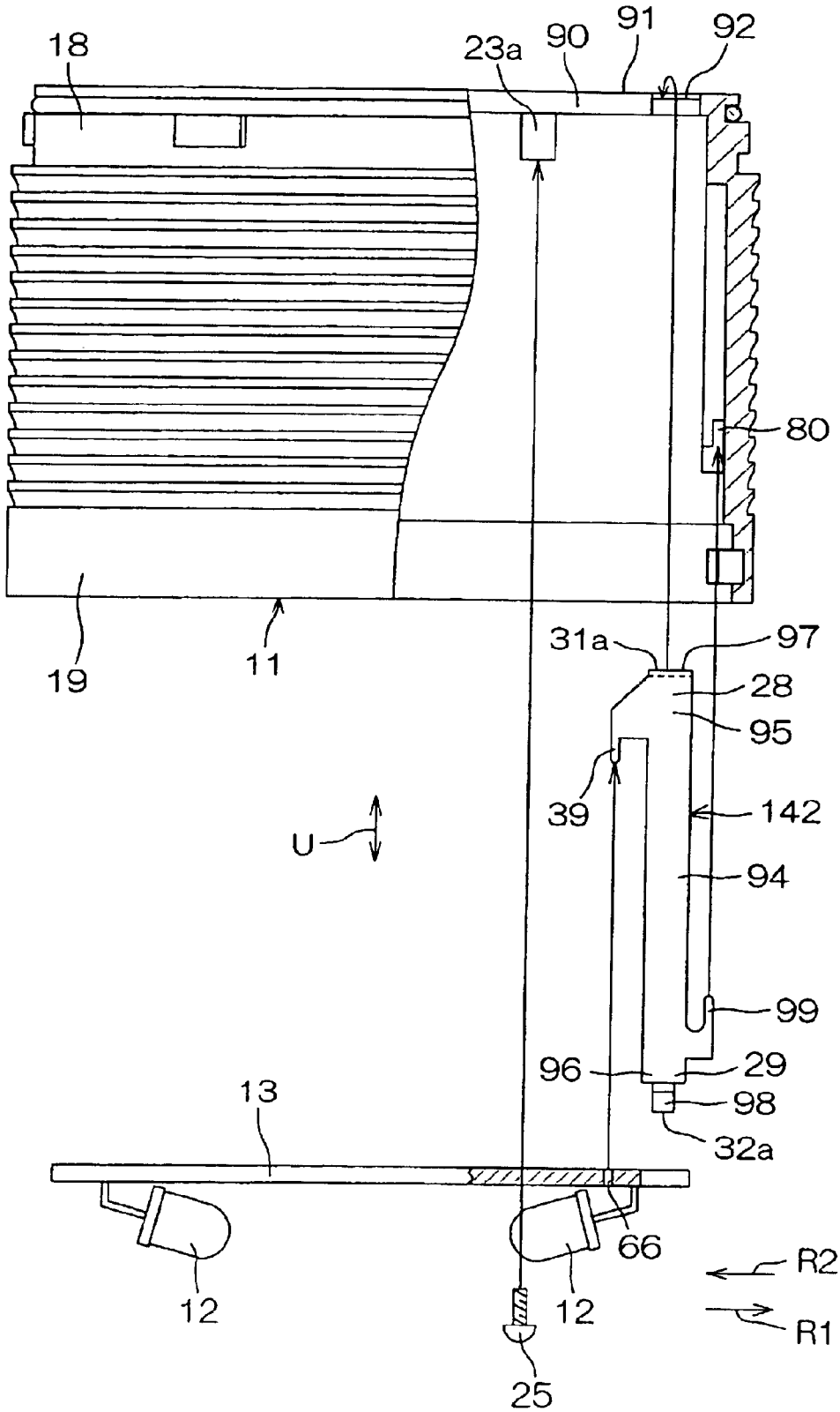
FIG. 13 is a partly cross-sectional disassembled front view of the annunciator unit shown in FIG. 12.

Next, a fourth embodiment of the invention will be described with reference to FIGS. 12 to 14B. As shown in FIGS. 12 and 13, the fourth embodiment employs an electrical connection member 142 consisting of a plate member, which replaces the electrical connection member 14 of the first embodiment which is formed of the combination of the plate member 15 and the wire 16 (see FIG. 2). The case 11 of the fourth embodiment differs from that of the first embodiment in that the case 11 is provided with an inwardly directed annular flange 90 at the first end portion 18 thereof, and that the flange is provided with bosses 23*a* having threaded holes in their inside circumferences such that the circuit board 13 may be locked to place by means of fixing screws 25 approaching from the second end portion 19 of the case 11 and screwed into the bosses.

The electrical connection member 142 includes first and second terminal portions 31*a*, 32*a* in place of the aforementioned first and second terminal portions 31, 32 (see FIG. 2). The first and second terminal portions 31*a*, 32*a* have the aforementioned contact portions 42*a*, 42*b*, respectively (see FIG. 10A). The electrical connection member 142 is a single conductive plate member incorporating the terminal portions 31*a*, 32*a*.

The electrical connection member 142 of the plate member has a main body 94 extended along the axial direction U of the case 11 and retained by the case 11. The first terminal portion 31*a* is provided at an extension portion 97 defined by a plate member portion extended substantially orthogonally from one end 95 of the main body 94. The first terminal portion 31*a* of the unit 3*b* is aligned with an outside surface 91 of the annular flange 90. The second terminal portion 32*a* is provided at a resilient tongue 98 of a chevron-shaped plate member portion extended from the other end 96 of the main body 94. The electrical connection member 142 includes the projected lead 39 for connection with the connection portion 66 defined by the through hole in the circuit board 13; and a projection 99 as an engagement portion extended from the other end 96 of the main body 94 and adapted to engage with the retention hole 80 of the case 11. The main body 94 is disposed in a manner that a plane of the main body 94 intersects the radial directions R1, R2 of the case 11.

Figure 14A:
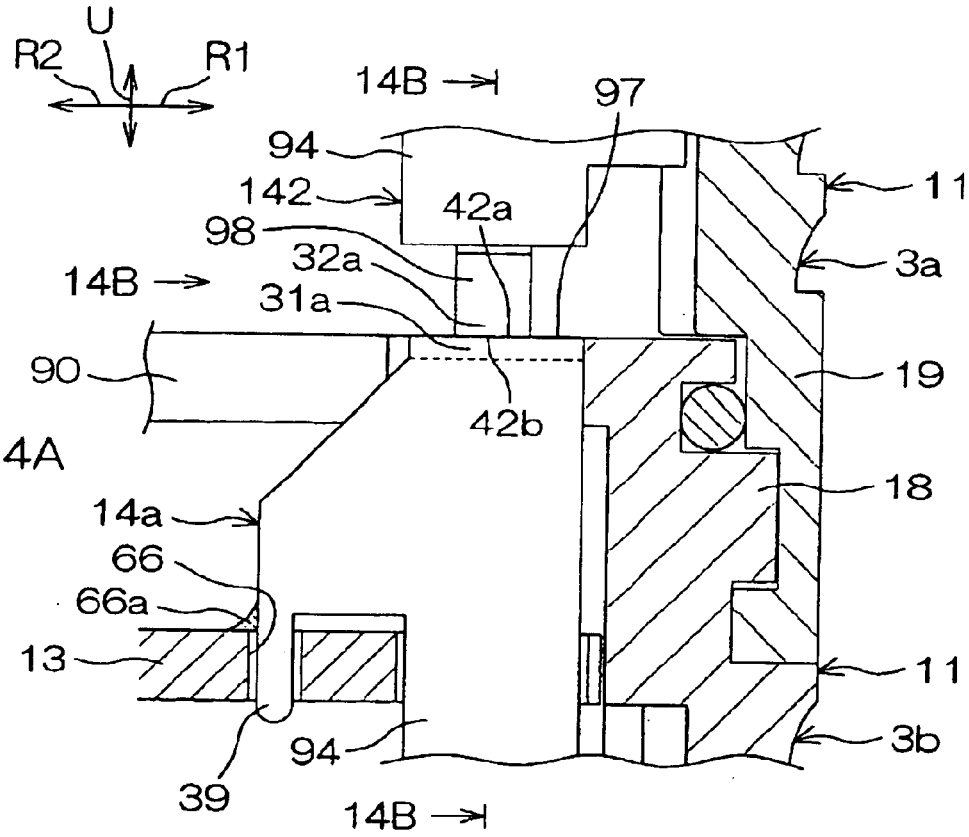
FIGS. 14A–14B are sectional views showing a connected state of the annunciator unit shown in FIG. 12, FIG. 14A representing a cross section taken on the line 14A—14A in FIG. 14B, whereas FIG. 14B representing a cross section taken on the line 14B—14B in FIG. 14A.
Figure 14B:
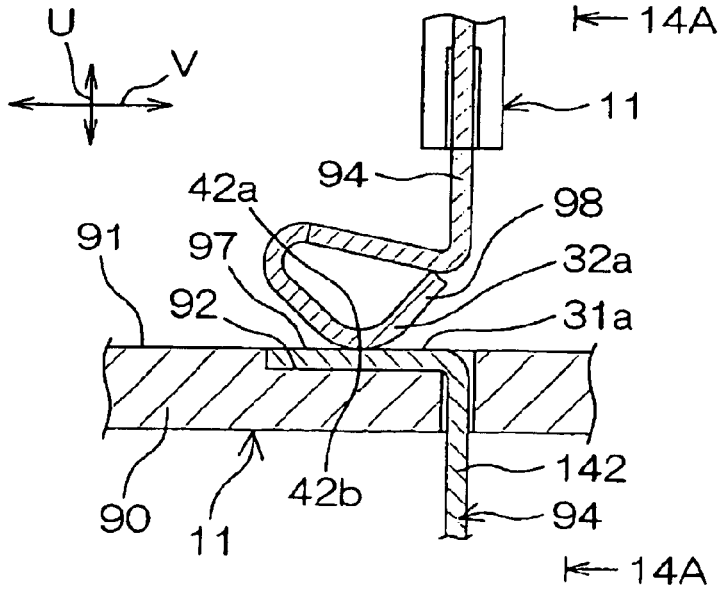

Referring to FIGS. 14A and 14B, the first terminal portion 31*a* is disposed in a recess 92 of the annular flange 90. The outside surface 91 of the annular flange 90 adjoining the recess 92 with respect to the circumferential direction V of the case 11 is substantially flush with the first terminal portion 31*a*.

The resilient tongue 98 provided with the second terminal portion 32*a* functions as a plate spring member cantilevered by the main body 94. The resilient tongue 98 is capable of resiliently biasing the second terminal portion 32*a* of the unit 3*a* against the corresponding first terminal portion 31*a* of the corresponding unit 3*b* along the axial direction U of the case 11.

In a state where the corresponding units 3*a*, 3*b* are in stacked relation, the resilient tongue 98 having the second terminal portion 32*a* is deflected by a given amount. The resultant resilient force of a given magnitude biases the second terminal portion 32*a* against the first terminal portion 31*a* resting on the annular flange 90, thereby bringing the contact portion 42*b* at the crest of the chevron-shaped second terminal portion into linear contact with the contact portion 42*a* of the first terminal portion 31*a*.

According to the second to fourth embodiments as described above, the units can be readily connected with each other by rotating the cases 11 thereof relative to each other, whereby the corresponding first and second terminal portions 31, 31*a*; 32, 32*a* of the respective pair of corresponding units 3*a*, 3*b*, 3*c* can be brought into the linear contact for establishing the reliable electrical connection between the corresponding units 3*a*, 3*b*, 3*c*.

The second and third embodiments provide advantages of increasing the assembly freedom by dividing the electrical connection member 140, 141 into plural members, and of facilitating the assembling steps by utilizing the sub-assembly 26.

Figure 15A:
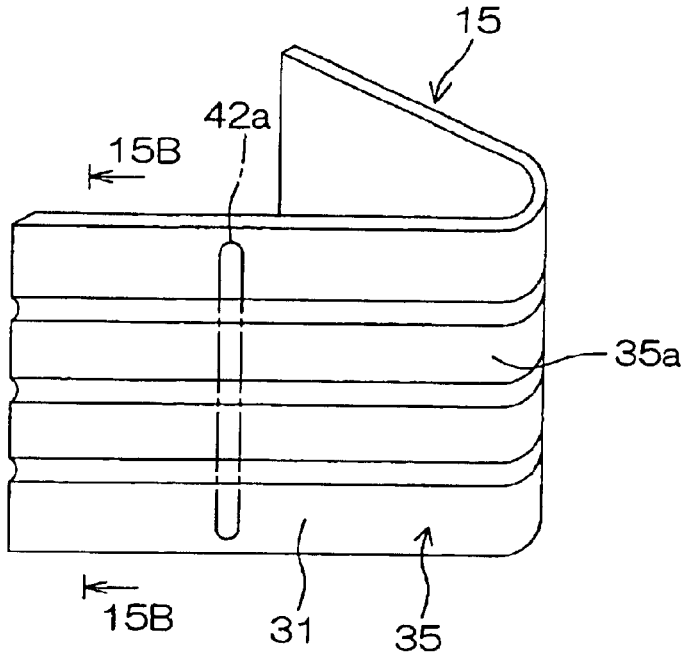
FIG. 15A is a perspective view showing an exemplary modification of the first terminal portion of the first embodiment, FIG. 15B representing a cross section taken on the line 15B—15B in FIG. 15A.
Figure 15B:
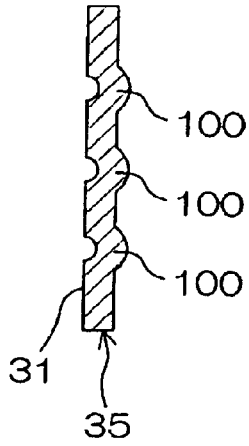

Referring to FIGS. 15A and 15B, the first resilient tongue 35 of the first embodiment may be reinforced by forming at least one or say three reinforcing ribs 100, which extend along the length the resilient tongue and project toward the opposite side from the contact portion of the first terminal portion 31. The rib 100 may be applied to the other resilient tongue of the first embodiment or to the resilient tongues of the second to fourth embodiments.

Figure 11:
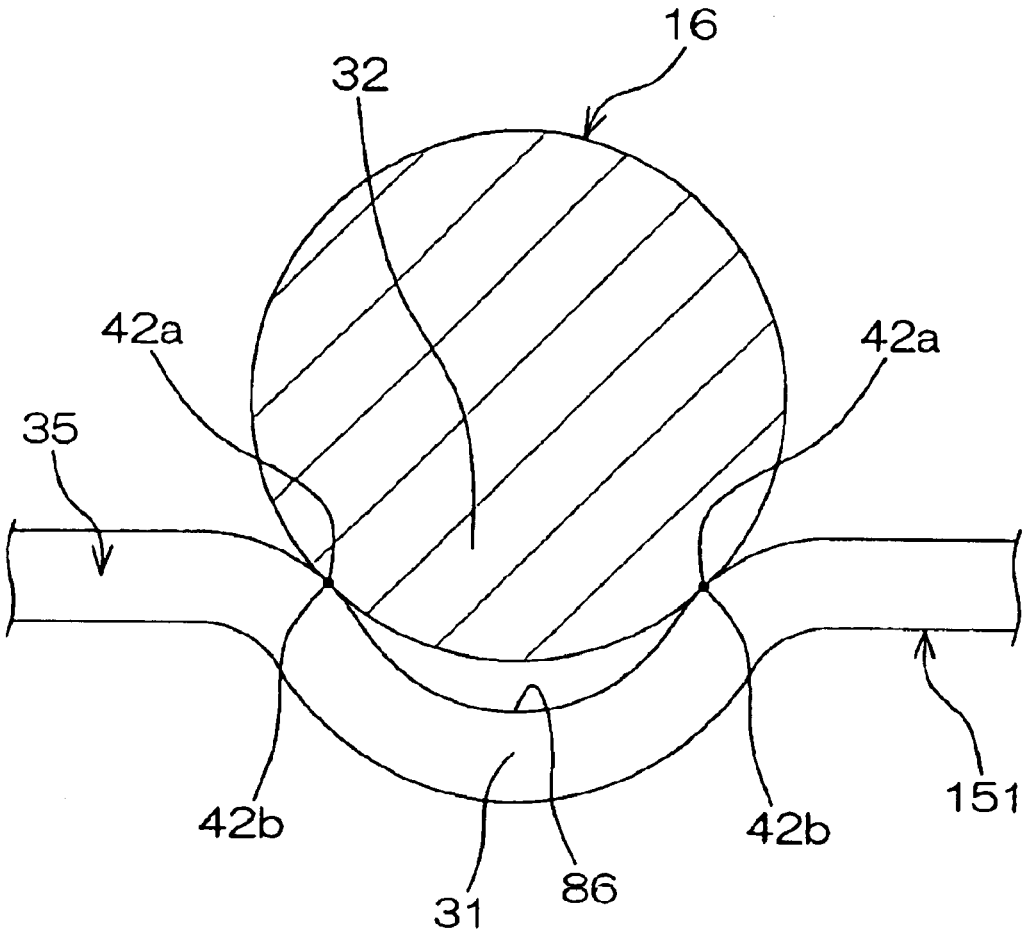
FIG. 11 is a partly cross-sectional plan view showing a state where a first terminal portion shown in FIG. 10B is connected with a second terminal portion of a corresponding unit and representing a cross section taken on the line XI—XI in FIG. 10B.

The flute 86 shown in FIG. 11 may be applied to the first terminal portion 31 of the first and second embodiments or to the first terminal portion 31*a* of the fourth embodiment.

The first to fourth embodiments may be arranged such that the corresponding contact portions 42*a*, 42*b* are brought into face-to-face contact.

Figure 16:
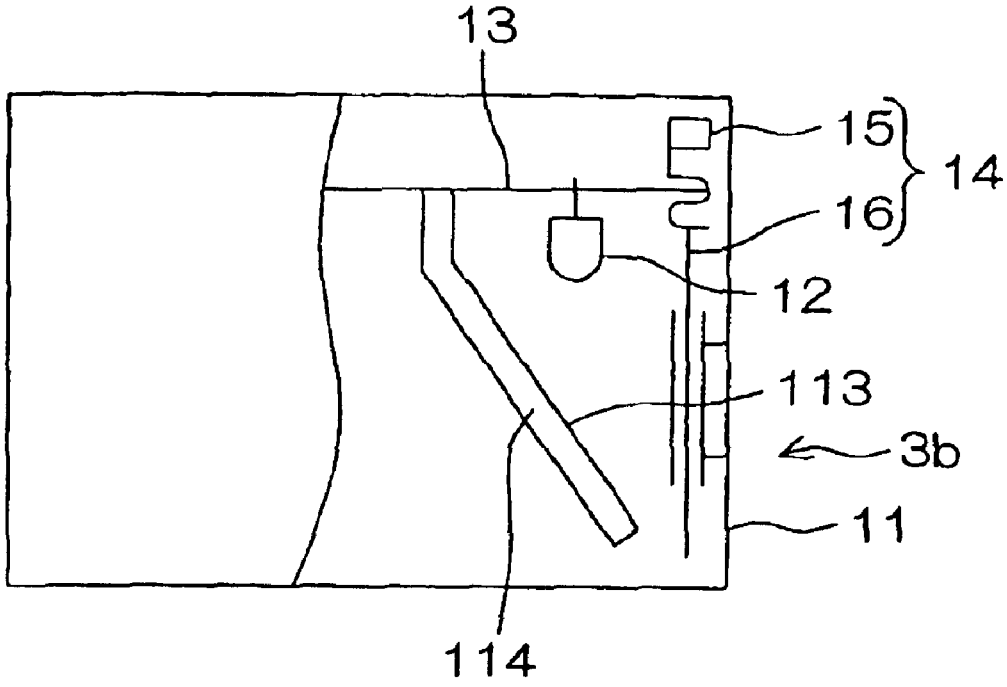
FIG. 16 is a schematic diagram showing an exemplary modification of annunciating means of the annunciator unit shown in FIG. 1.

As shown in FIG. 16, the signal generating means may further include, additionally to the light source 12, a reflection surface 113 as reflection means for reflecting the light from the light source 12 to peripheral area; and a bearing member 114 for bearing the reflection surface 113. As illustrated by the buzzer unit 5 shown in FIG. 5, the signal generating means may adopt, in place of the light source 12, a buzzer 101 as sound generating means for annuciating via sound; and an electric circuit (not shown) for driving the buzzer 101. In this example, the case 11 is formed with an aperture 102 for emitting the sound of the buzzer 101 to the outside.

Figure 1B:
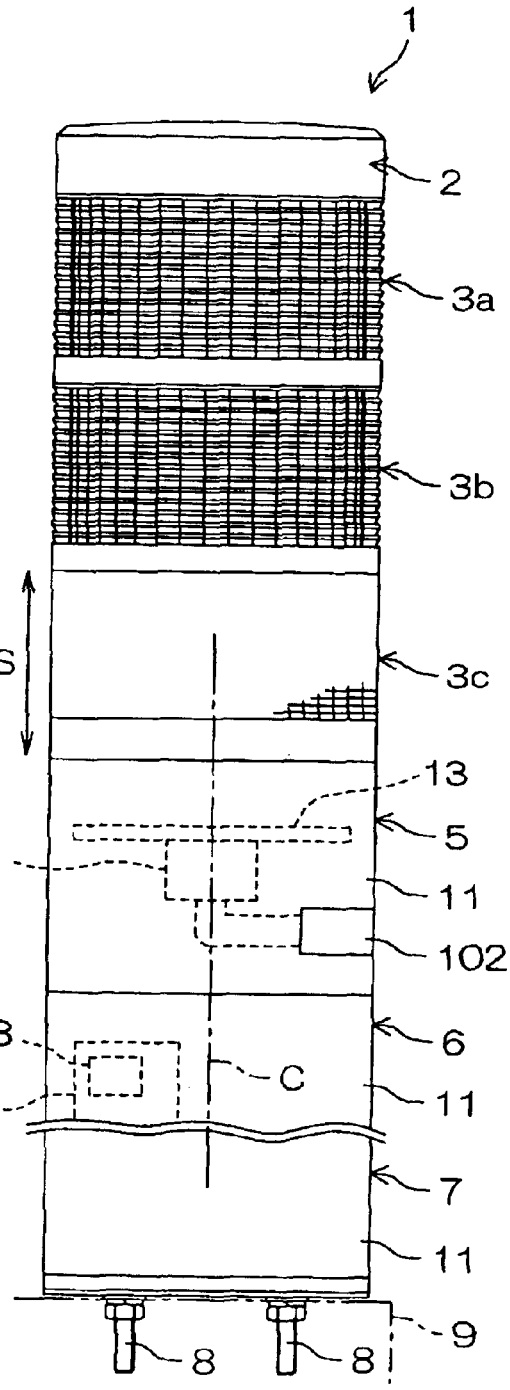

The units 6, 7 shown in FIG. 1 also employ the case 11 and the electrical connection member 14, 142 according to any one of the foregoing embodiments. For instance, the output unit to external 6 has an interface 117 for output to external, the interface 117 permitting an output signal corresponding to a signal from the apparatus main body 9 mounting the indicating lights 1 to be outputted to an external apparatus such as a central control unit of a production line including the apparatus main body 9. The output unit to external 6 has a connector 118 fixed to the case 11 as exposed to the outside such as to lead out the output signal.

The invention does not limit the number and types of the units included in the indicating lights 1 to the above. What is required is that at least one annunciator unit 3*b* is included.

While the invention has been specifically described by way of specific embodiments thereof, modifications, changes or equivalents thereto will occur to those skilled in the art fully understanding the above description. The scope of the invention is therefore to be determined by the following claims and equivalents thereto.

What is claimed is:

1. A stackable unit for indicating lights comprising:

a cylindrical case (11) having first and second end portions (18, 19);

a pair of connection means (20, 21) disposed at the first and second end portions (18, 19) of the case (11), respectively, and each establishing connection with a corresponding end portion (18, 19) of a case (11) of a corresponding unit (3*a*, 3*b*, 3*c*, 5, 6, 7) via relative rotation of the cases; and an electrical connection member (14, 140, 141, 142) extended between the first and second end portions (18, 19) of the case (11) for establishing electrical connection between units (3*a*, 3*b*, 3*c*, 5, 6, 7) corresponding to each other, wherein the electrical connection member (14, 140, 141, 142) at least includes a plate member (15, 150, 151, 142) as a part thereof, wherein first and second ends (28, 29) of the electrical connection member (14, 140, 141, 142) are provided with first and second terminal portions (31, 31*a*; 32, 32*a*), respectively, each terminal portion establishing connection with a corresponding terminal portion (31, 31*a*; 32, 32*a*) of a corresponding unit (3*a*, 3*b*, 3*c*, 5, 6, 7), and wherein at least one of the first and second terminal portions (31, 31*a*; 32, 32*a*) is provided with the plate member (15, 150, 151, 142) and includes a contact portion (42*a*, 42*b*) capable of resiliently establishing linear or face-to-face contact with a corresponding terminal portion (31, 31*a*; 32, 32*a*) of a corresponding unit (3*a*, 3*b*, 3*c*, 5, 6, 7).

2. The unit for indicating lights according to claim 1, wherein the electrical connection member (14, 140, 141, 142) includes interconnectable first and second members (15, 150, 151; 16).

3. The unit for indicating lights according to claim 2, wherein the first member (15, 150, 151) has the first terminal portion (31, 31*a*) at one end (15*e*) thereof, and a first internal terminal portion (71) at the other end (15*f*) thereof, and wherein the second member (16) has a second internal terminal portion (72) at one end thereof (75) for connection with the first terminal portion (31, 31*a*) of the first member (15, 150, 151), and the second terminal portion (32, 32*a*) at the other end (76) thereof.

4. The unit for indicating lights according to claim 2, further comprising a circuit board (13) retained by the case (11), wherein the first member (15, 150, 151) includes a plate spring member (33, 35, 36) assembled to the circuit board (13), and wherein the second member (16) includes a wire (16) retained by the case (11).

5. The unit for indicating lights according to any claim 2, wherein there is provided a sub-assembly (26) including the first member (15, 150, 151) and the circuit board (13).

6. The unit for indicating lights according to claim 5, wherein the first member (15, 150, 151) includes a retained portion (33) retained by the circuit board (13); a first resilient tongue (35) extended from the retained portion (33) and including the first terminal portion (31, 31*a*); and a second resilient tongue (36) extended from the retained portion (33) and including a first internal terminal portion (71).

7. The unit for indicating lights according to claim 6, wherein the retained portion (33) includes a U-shaped plate portion (33) defining an insertion portion (64) capable of receiving an outer edge (63) of the circuit board (13).

8. The unit for indicating lights according to claim 6, wherein the first resilient tongue (35) is capable of resiliently biasing the first terminal portion (31, 31*a*) substantially along radial directions (R1, R2) of the case (11).

9. The unit for indicating lights according to claim 6, wherein the second resilient tongue (36) is capable of resiliently biasing the first internal terminal portion (71) substantially along an axial direction (U) of the case (11).

10. The unit for indicating lights according to any one of claims 4 to 9, wherein the wire (16) includes a main body (73) extended along an axial direction (U) of the case (11) and retained by the case (11), wherein the main body (73) is provided with a bent extension (78) at one end thereof (77), the bent extension (78) provided with the second internal terminal portion (72), and wherein the main body (73) is provided with the second terminal portion (32) at the other end (76) thereof.

11. The unit for indicating lights according to claim 1, wherein an inwardly directed annular flange (90) is provided at the first end portion (18) of the case (11), and wherein the electrical connection member (14, 140, 141, 142) includes the electrical connection member (142) comprising the conductive plate member (142).

12. The unit for indicating lights according to claim 11, wherein the plate member (142) includes a main body (94) extended along an axial direction (U) of the case (11) and retained by the case (11), and an extension portion (97) substantially orthogonally extended from one end (95) of the main body (94) and aligned with a surface (91) of the annular flange (90), and wherein the first terminal portion (31*a*) is provided at the extension portion (97).

13. The unit for indicating lights according to claim 12, wherein the plate member (142) includes a resilient tongue (98) extended from the other end (96) of the main body (94) in a chevron shape, wherein the resilient tongue (98) is provided with the second terminal portion (32*a*), and wherein the resilient tongue (98) is capable of resiliently biasing the second terminal portion (32*a*) against a corresponding first terminal portion (31*a*) of a corresponding unit (3*a*, 3*b*, 3*c*, 5, 6, 7) along the axial direction (U) of the case (11).

14. Indicating lights comprising a plurality of units (3*a*, 3*b*, 3*c*, 5, 6, 7) according to any one of claims 1 to 9.

15. The indicating lights according to claim 14, wherein the plural units (3*a*, 3*b*, 3*c*, 5, 6, 7) includes at least one unit (3*a*, 3*b*, 3*c*) having means (12) for emitting light, and a base unit (7) having a fixing member (8) for fixing the indicating lights (1).

16. The indicating lights according to claim 15, wherein the plural units (3*a*, 3*b*, 3*c*, 5, 6, 7) includes a unit (6) having means for generating sound.

17. The indicating lights according to claim 15, wherein the plural units (3*a*, 3*b*, 3*c*, 5, 6, 7) includes a unit (7) having an interface (117) for output to external.

18. Indicating lights comprising a plurality of units (3*a*, 3*b*, 3*c*, 5, 6, 7) according to claim 10.

19. Indicating lights comprising a plurality of units (3*a*, 3*b*, 3*c*, 5, 6, 7) according to any one of claims 11 to 13.

* * * * *